US007980505B2

(12) United States Patent
Doeres et al.

(10) Patent No.: US 7,980,505 B2
(45) Date of Patent: Jul. 19, 2011

(54) METHOD FOR CALCULATING THE DIAMETER OF A CONTINUOUS-MATERIAL REEL ON A ROLLER, AND A REEL-CONTROL SYSTEM

(75) Inventors: Hans-Juergen Doeres, Frammersbach (DE); Stephan Schultze, Lohr-Wombach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/252,799

(22) Filed: Oct. 16, 2008

(65) Prior Publication Data

US 2009/0101747 A1 Apr. 23, 2009

(30) Foreign Application Priority Data

Oct. 17, 2007 (DE) ..... 10 2007 049 680

(51) Int. Cl.
*B65H 19/10* (2006.01)

(52) U.S. Cl. ..... 242/554.3; 242/554.4; 242/554.6

(58) Field of Classification Search ..... 242/534.2, 242/554.2–554.4, 554.6, 564.1, 413.2, 413.9, 242/421.2, 421.4

See application file for complete search history.

(56) References Cited

U.S. PATENT DOCUMENTS 3,825,201 A * 7/1974 Osta ..... 242/554.3
4,077,580 A 3/1978 Lang et al.
4,278,213 A * 7/1981 Rubruck ..... 242/420.2
4,337,903 A * 7/1982 Kessler et al. ..... 242/554.2
5,152,472 A * 10/1992 Spang et al. ..... 242/554.2
6,629,664 B2 * 10/2003 Weijenborg ..... 242/554.5

FOREIGN PATENT DOCUMENTS

DE 2 128 617 2/1973
DE 26 19 236 11/1977
DE 39 27 172 2/1991

* cited by examiner

*Primary Examiner* — Sang Kim
(74) *Attorney, Agent, or Firm* — Michael J. Striker

(57) ABSTRACT

In a method for calculating the diameter of a continuous-material reel on a roller, with which the roller is mounted on a swivel arm that is swivelable about a swiveling axis; the roller rotates at a changeable winding speed, and the continuous material is unwound from the roller and directed to a continuous-material machine, or it is removed from a continuous-material machine and wound onto the roller, the winding speed is set as a function of the web-conveyance speed, and the diameter of the continuous-material reel is calculated in a reel-control system; the winding speed is changed when the swivel arm on which the roller is mounted is swiveled about its swiveling axis during the winding motion; a correction value for correcting the change in winding speed is incorporated in the calculation of the diameter of the continuous-material reel, the correction value being determined within the reel-control system, and a related reel-control system is provided.

14 Claims, 2 Drawing Sheets

METHOD FOR CALCULATING THE DIAMETER OF A CONTINUOUS-MATERIAL REEL ON A ROLLER, AND A REEL-CONTROL SYSTEM

CROSS-REFERENCE TO RELATED APPLICATION

The invention described and claimed hereinbelow is also described in German Patent Application DE 10 2007 049 680.1 filed on Oct. 17, 2007. This German Patent Application, whose subject matter is incorporated here by reference, provides the basis for a claim of priority of invention under 35 U.S.C. 119(a)-(d).

BACKGROUND OF THE INVENTION

The present invention relates to a method for calculating the diameter of a continuous-material reel on a roller, and to a reel-control system. The present invention also relates to a computer program and a computer program product.

Although the text below refers mainly to printing presses and their reel changers and control devices, the present invention is not limited thereto, but rather is directed to all types of web-processing machines with which the diameter of a continuous-material reel is to be determined. The present invention may be used, in particular, with printing presses such as newspaper presses, jobbing presses, gravure presses, printing presses for packaging or currency, and processing machines such as bagging machines, envelope machines, or packaging machines. The continuous material may be paper, cardboard, plastic, metal, rubber, or foil, etc.

The present invention may be used, in particular, to determine the diameter of continuous-material reels on reel carriers and/or reel changers. A reel changer typically includes at least two swivel arms that are swivelable about a swiveling axis, and on each of which a roller is mounted that is used to wind or unwind a material web. The swivel arms are typically free to swivel about the swiveling axis with the aid of an electric drive, so that a flying reel change may be carried out at full production speed. During processing, one of the rollers is connected with the machine via the material web, and the material web is either removed from the machine via the outfeed and wound onto the roller, or it is unwound from the roller and directed to the machine infeed. The roller is also driven by a drive, typically a center drive, a circumferential drive, or the like.

The diameter of the material web wound on the roller changes continually during the winding procedure and is determined by a reel-control system, e.g., based on the ratio of the winding speed to the web-conveyance speed. The web-conveyance speed is tapped at a reference axle, in particular a web-conveyance axle, with the reference axle defining a reference to the conveyance speed of the material web. The reference axle may also be a simulated or emulated axle (a "virtual" axle). The diameter of the reel is proportional to the ratio of the two known speeds. The reel-control system controls the winding process and the reel-changing process. During the reel-changing process, the swivel arm with the reel that is currently being used in production is swiveled away from the web-processing machine, and the swivel arm with the replacement reel is swiveled toward the web-processing machine. The swivel motion of the swivel arm affects the winding or unwinding speed, i.e., the rotational speed of the roller, since the roller must compensate for a lengthening or shortening of the length of the web by making an unwinding or winding motion. This compensation motion results in an effective winding or unwinding speed (rotational speed) that is no longer proportional to the diameter of the reel. The determination of the diameter during the swivel motion is therefore erroneous, with the error increasing as the web-conveyance speed slows, as the swivel speed increases, or the longer the swivel arm is.

With small reel diameters in particular, the swivel motion results in a large miscalculation. This is particularly problematic with unwind procedures, since, in this case, the reel change is typically carried out when the diameters are small. The relatively great error that results—for the reasons stated above—in the calculation of diameter is typically accompanied by a sufficient reserve of material on the roller. The material is therefore not utilized in an optimal manner.

To prevent the problems mentioned above, it is known to stop the calculation of diameter during a swivel motion. As a result, a current diameter value is not available for the period of time in which the swivel motion takes place, which is particularly disadvantageous when the reel diameter is small.

It is also known to specify a correction speed using a control system or entity that is higher-order than the reel control system. This is beset with several problems, since numerous quantities and/or parameters that are necessary in order to determine the correction speed must be transferred to the higher-order control system and/or must be determined by the control system.

SUMMARY OF THE INVENTION

The object of the present invention, therefore, is to improve the calculation of the diameter while a swivel motion is being carried out.

This object is attained via a method for calculating the diameter of a continuous-material reel on a roller, a reel-control system, a computer program, and a computer program product having the features of the independent claims. Advantageous refinements are the subject of the subclaims and the description below.

According to the present invention, the diameter of a continuous-material reel on a roller is calculated. The roller is mounted on a swivel arm that is swivelable about a swiveling axis. The roller rotates at a changeable winding speed, with the material web being unwound from the roller and directed to a material-web machine, or being removed from a material-web machine and wound onto the roller. The roller and the swivel arm are, in particular, part of a reel changer having a center drive, a circumferential drive, or the like. The winding speed is set as a function of the web-conveyance speed, in order to ensure that the winding motion is synchronized with the web-conveyance speed. The diameter of the continuous-material reel on the roller is calculated in a reel-control system. The winding speed changes when the swivel arm on which the roller is mounted is swiveled about its swiveling axis during the winding motion. A correction value for correcting the change in winding speed is incorporated in the calculation of the diameter of the continuous-material reel, with the correction value being determined within the reel-control system.

The present invention also relates to a related reel-control system that is designed to determine the diameter and the correction value, and to take them into account in the diameter calculation.

According to the present invention, a correction value is determined that is used, in particular, to correct the speed ratio or angular-position ratio of the reel axle and the reference axle, in order to ensure that the diameter is determined correctly while the swivel motion is carried out. The correction value is used as the precontrol and/or feedforward for the reel-control system. According to the present invention, the correction value is determined and specified by the same reel-control system that carries out the diameter calculation and preferably controls the motion of the swiveling axis. The determination of the diameter of the reel is improved, in particular at low machine speeds and a high swivel speed. An interruption of the diameter determination during the swiveling process may be advantageously eliminated.

The correction may be carried out, in particular, by incorporating (adding or subtracting) the correction value with the related quantity of the reel axle, i.e., the rotational speed or the angular position. The quotient of the corrected reel-axle quantity and the related reference-axle quantity is used to calculate the diameter. It is understood that the reference-axle quantity may also be corrected using the correction value.

To determine the correction speed, quantities are required that are typically present internally in the reel-control system or that may be easily determined. A further advantageous feature of the combination of swivel control, reel control, diameter determination, and correction-value determination is the associated reduction in data transmission to higher-order entities, and the simpler embodiment of these entities.

It is particularly advantageous when the correction value is used to precontrol the winding speed of the roller on which the reel is installed. During a swiveling process, the roller drive must perform a rotational motion in order to compensate for the lengthening or shortening of the material web. This rotational motion is now also applied to the position and/or setpoint speed of the roller drive as a precontrol of the motion of the roller drive. As a result, depending on the design of the reel changer, a jockey roller that may be present remains in the neutral position or remains motionless, or, if a jockey roller is not present, the web-tension regulator need not carry out an actuating motion. The disadvantage of the related art is therefore eliminated, namely that the position of the jockey roller does not remain constant while a swiveling motion is being carried out, and it is not compensated for until a control deviation occurs in the controller of the jockey-roller position.

It is advantageous when a correction speed $\omega_K$ is determined as the correction value, and the diameter D of the continuous-material reel is calculated based on winding speed $\omega$ and the web-conveyance speed. Correction speed $\omega_K$ delivers a positive or negative correction value for angular speed $\omega$ or the web-conveyance speed. The web-conveyance speed at a time $t_0$ may be determined, e.g., as the product $r_R \cdot \omega_R(t_0)$ of radius $r_R$ and rotational speed $\omega_R(t_0)$ of a reference axle R, e.g., a web-conveyance axle of the web infeed. Uncorrected diameter $D(t_0)$ of the reel on the roller at time $t_0$ is therefore determined easily as $D(t_0)=2r_R \cdot \omega_R(t_0)/\omega(t_0)$ and, with consideration for the correction speed in particular, as $D(t_0)=2r_R \cdot \omega_R(t_0)/(\omega(t_0)+\omega_K(t_0))$.

It is also advantageous that corrective angular position $\Phi_K$ is determined as a correction value, and diameter D of the continuous-material reel is calculated based on an angular position $\Phi$ of the roller and an angular position $\Phi_R$ of a web-conveyance axle and/or a reference axle. Corrective angular position $\Phi_K$ yields a positive or negative correction value for angular position $\Phi$ of the roller or the angular position $\Phi_R$ of the reference axle. The diameter may always be calculated, e.g., when angular position $\Phi$ of the roller (or angular position $\Phi_R$ of the reference axle) has reached a predetermined value, e.g., 360°. At this time T, angular position $\Phi_R(T)$ of the roller is determined. Uncorrected diameter D(T) of the reel on the roller at time T is therefore easily determined as $D(T)=2r_R\Phi_R(T)/\Phi$ and, with consideration for the corrective angular position in particular, as $D(T)=2r_R \cdot \Phi_R(T)/(\Phi+\Phi_K)$. The difference between using angular positions and using speeds is that, when speeds are used, if a machine is at a standstill, it would be necessary to divide 0/0. When angular positions are used instead, diameter is only calculated when one of the angular positions exceeds a certain limiting value. Division of 0/0 is therefore prevented.

It is advantageous when the correction value is determined within the reel-control system as a function of a length and a swivel speed of the swivel arm. The correction speed depends, in particular, on (constant) geometry data, i.e., the swivel arm length, the distance between the swiveling axis and the machine axle that receives/delivers the material web, and on current process data (current actual values), such as the current angular position of the swivel arm, the current diameter of the reel, and the current swiveling speed. Regarding the present invention, it is particularly advantageous that the current process data mentioned above are already available within the reel-control system, which makes it possible to calculate the correction value without data transmission, which is complex.

The correction value may be calculated as a function of the rotational speed of the swivel arm, of the position-dependent swivel-arm characteristic curve or support-point characteristic curve, and/or the sum of the radius of the winding and the position of the swivel arm. Advantageously, all of the factors mentioned above are used. The geometric relationships that result depending on the position of the swivel arm are reflected in the position-dependent, swivel-arm characteristic curve.

In a preferred embodiment, the support-point characteristic curve includes a rotation of the swivel arm, i.e., 0° through 360°. In certain embodiments, however, it is advantageous to store only a portion of the entire rotation, since, with a reel changer, the active roller is typically swiveled only within a subrange of the entire rotation, since the roller located outside of this range is not active, i.e., it does not perform winding. The support-point characteristic curve may be determined with the aid of a measurement run, in which case the related table value is determined at several angular positions of the swivel arm with reference to the reel speed of the roller and to the swivel speed. It is also possible to perform the determination based on the known geometric configuration. It is advantageous to reduce the support-point characteristic curve to a few support points, between which interpolation is carried out in a suitable manner.

Points located outside of the support-point characteristic curve are extrapolated in a suitable manner.

In addition to the use of a support-point characteristic curve, the determination of a calculated, geometry-dependent factor is also provided. This factor may be calculated based on the known geometric configuration of the reel changer and the web machine, it being possible, in particular, to perform a calculation within the reel-control system. The geometric parameters may be applied in the reel-control system, e.g., during start-up or production. It is also feasible, as an alternative, to use an approximation formula. With unwind procedures, for example, the current diameter may be disregarded when the length of the swivel arm is used.

The support-point characteristic curve and the calculated factor may be stored within the reel-control system, where they are calculated or are specified by a higher-order entity.

The present invention also relates to a computer program having program code means for carrying out all steps for calculating the diameter and the correction value according to a method according to the present invention when the computer program is run on a computer or a related arithmetic unit, in particular in a reel-control system according to the present invention.

The computer program product—which is provided according to the present invention—having program code means, which are stored on a computer-readable data storage device, is suitable for carrying out all steps for calculating the diameter and the correction value according to a method according to the present invention when the computer program is run on a computer or a related arithmetic unit, in particular in a reel-control system according to the present invention. Suitable data storage devices are, in particular, diskettes, hard drives, Flash drives, EEPROMs, CD-ROMs, DVDs, etc. It is also possible that a program could be downloaded from computer networks (Internet, intranet, etc.).

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
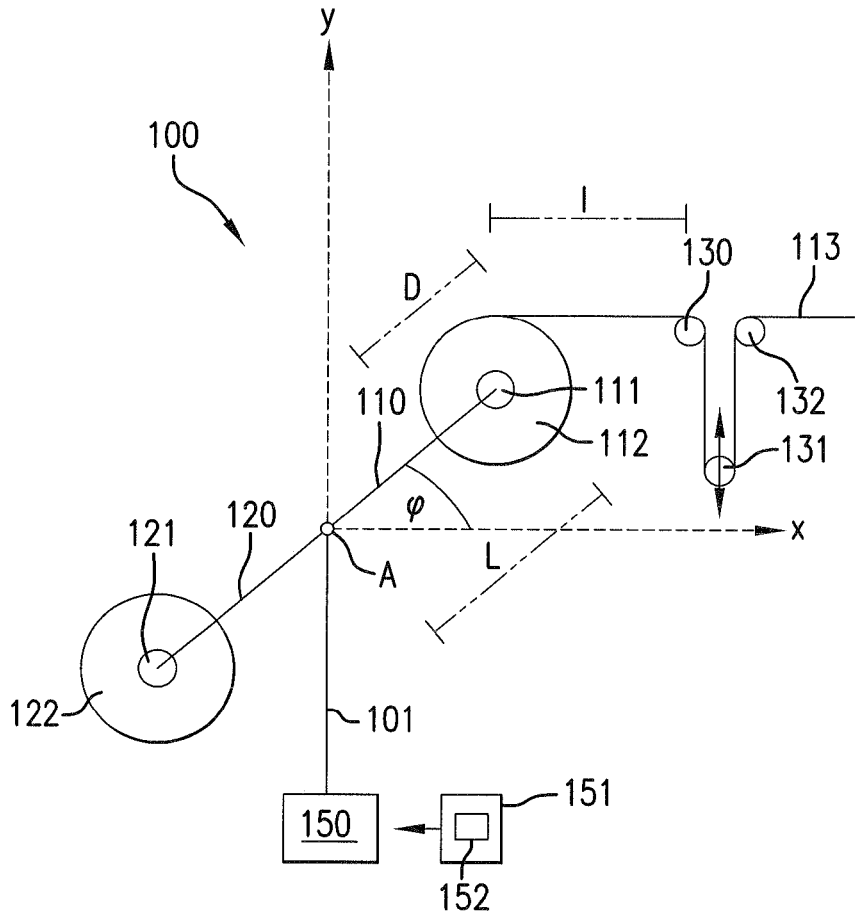
FIG. 1 shows a schematic depiction of a reel changer for use with a preferred embodiment of the present invention, and an example of a reel-control system according to the present invention.

A reel changer for a continuous-material machine is shown schematically and is labeled with reference numeral 100 in FIG. 1. Reel changer includes a base foot 101, on which a first swivel arm 110—which is swivelable around a swiveling axis A—and a second swivel arm 120—which is swivelable about swiveling axis A—are mounted. First swivel arm 110 includes—on its end facing away from the base—a rotatable, drivable roller 111, on which a reel 112 of a continuous material 113 is installed. The reel changer is controlled by a preferred embodiment of a reel-control system 150 according to the present invention, which includes means for controlling a winding motion of rollers 111 and 121, means for controlling the swiveling motion of swivel arms 110 and 120, means for calculating diameter D of continuous-material reels 112 and 122 on rollers 111 and 121, and means for determining a correction value for correcting the change in angular speed in response to a swivel motion of swivel arms 110 and 120, on which rollers 111, 121 are mounted.

In the embodiment shown, continuous material 113 is unwound from roller 111 and is guided to an infeed of a continuous-material machine via a first deflection roller 130, a movable jockey roller 131, and a second deflection roller 132. Jockey roller 131, which may be moved up and down, e.g., using compressed air, is used to regulate the drive speed of roller 111.

In the case of the jockey roller shown, the web tension is applied via a force of jockey roller 131. A higher-order jockey-roller controller ensures that jockey roller 131 remains within its mechanical limits. The position of the jockey roller is the measured quantity of the jockey-roller controller, and the manipulated variable of the controller of the jockey-roller position is an additive position/speed of the roller drive. Systems also exist that do not include jockey rollers. In these systems, the web tension is applied via the torque of the roller drive. In this case, however, a higher-order force controller controls the web tension. The measured quantity is the web tension, which is measured, e.g., via a load cell, and the manipulated variable is the torque and/or torque limitation of the roller drive.

The length of first swivel arm 110 from swivel axis A to the center point of roller 111 is labeled L. The current diameter of reel 112 is labeled D. In the position shown, diameter D of reel 112 corresponds to the ratio of the diameter times rotational speed of deflection roller 130 to the angular speed of roller 111. The length of continuous material 113 between reel 112 and first deflection roller 130 is labeled 1. A coordinate system with the origin at swivel axis A is stored in order to depict the geometric details in FIG. 1. The angle that swivel arm 110 makes with the x-axis of the coordinate system is labeled $\phi$.

In its mechanical embodiment, second swivel arm 120 corresponds to first swivel arm 110 and has a reel 122 mounted on its roller 121, reel 122 being provided for a flying reel change. To perform the flying reel change, first swivel arm 110 and second swivel arm 120 are swiveled in the counterclockwise direction until second reel 122 enters into an operative connection with continuous material 113. Continuous material 113 is then separated from reel 112—using suitable cutting devices, which are not depicted—and is connected with reel 122.

In the case of the swivel motion described above, length 1 of continuous material 113 from reel 112 to first deflection roller 130 increases. This change in length must be compensated for by an increased angular speed or rotational speed of roller 111, in order to hold the jockey roller in its position. As a result, the ratio—described above—of the conveyance speed of the continuous material to the rotational speed or angular speed of roller 111 is no longer proportional to current diameter D of reel 112. To correct the deviation, a correction value is used in the diameter calculation, which is used to allow for the change in angular speed caused by the swivel motion in the diameter calculation. As described above, this allowance may take place, e.g., with regard for the rotational speed or the angular position.

Figure 2:
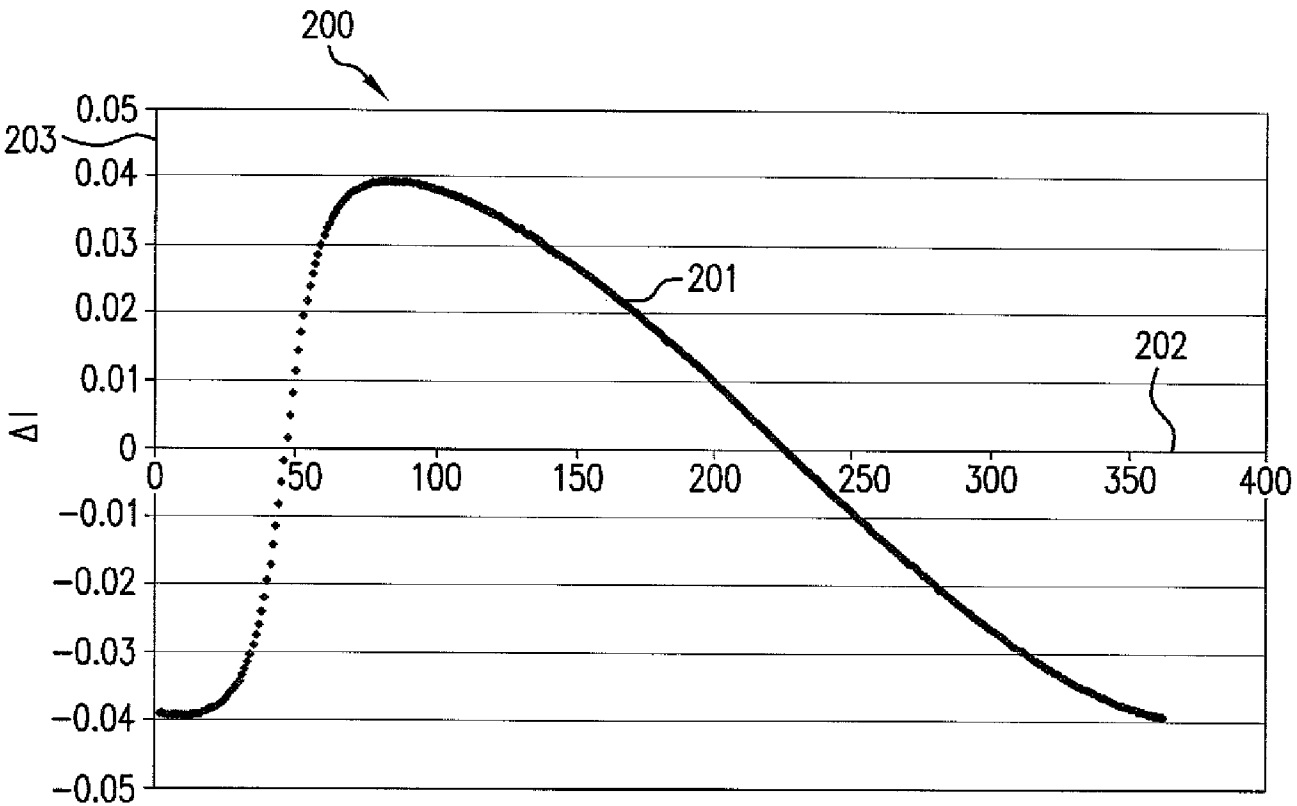
FIG. 2 shows an embodiment of a support-point characteristic curve.

Diagram 200 in FIG. 2 is a depiction of a support-point characteristic curve 201 that was calculated based on the geometric relationships depicted in FIG. 1. The support-point characteristic curve is one of the preferred possibilities for determining a correction value to correct the change in angular speed. It should be noted that, instead of obtaining a value via a support-point characteristic curve, it is also possible to calculate the correction value directly in the reel-control system.

In diagram 200, a change $\Delta 1$ in length 1 is plotted on a y-axis 203 against swivel angle $\phi$, which is plotted on x-axis 202. The depiction corresponds to a rotation of swivel arm 110 in the counterclockwise direction about swivel axis A. Every support point corresponds to the change in length 1 that occurs given a deflection of 1°. The basic geometry is a swivel arm length L=2.0 m, a current diameter D=0.5 m, and an (x/y) position of first deflection roller 130 of (2.0/2.0). Given these values, length L changes, e.g., by $\Delta 1$=0.0346 m when swiveling from 120° to 121°, which is represented by a support point (120°/0.0346) and corresponds to a lengthening of the continuous material by 0.0346 m. Negative values represent a shortening of the continuous material. The change in length 1, which is brought about by a displacement of the tangential point at reel 112, is disregarded in this consideration. It is understood that this displacement may also be taken into account in a more exact correction. Likewise, a constant diameter is used with the support-point characteristic curve shown. This is always advantageous when the diameter of the reel is small compared with the length of the swivel arm, and is therefore advantageous with the unwind procedures described above in particular.

To determine the correction value for a swivel procedure, all values between the starting angle of the swiveling procedure and the end angle of the swiveling procedure must be summarized. This summary is used to determine the total change in length of the continuous material between roller 111 and first deflection roller 130. The values that are obtained from the characteristic curve or, preferably, that are calculated on-line, are now used to correct the diameter calculation. When the correction is carried out using a corrective angular position $\phi_K$ as the correction value, the length change $\Delta 1$ that is determined is converted—based on the current diameter of the reel—to corrective angular position $\phi_K$. This component is then added to the angular position that is actually determined, as described above. According to a further preferred embodiment of the present invention, the correction values are used to precontrol the drive of roller 111 in order to prevent jockey roller 131 from moving.

It is understood that the embodiments of the present invention depicted in the figures are merely examples. Any other type of embodiment is also feasible, without leaving the framework of the present invention.

It will be understood that each of the elements described above, or two or more together, may also find a useful application in other types of methods and constructions differing from the types described above.

While the invention has been illustrated and described as embodied in a method for calculating the diameter of a continuous-material reel on a roller, and a reel-control system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of calculating a diameter of a continuous-material reel on a roller mounted on a swivel arm pivotable about a swiveling axis and rotating at a changeable winding speed, with a continuous material unwound from the roller and directed to a continuous-material machine or removed from a continuous-material machine and wound onto the roller, the method comprising the steps of:

providing a reel-control system, said reel-control system having means for unwinding a continuous material from the roller and directing to a continuous-material machine or removing from a continuous-material machine and winding onto the roller; means for controlling a swivel motion of a swivel arm with which the roller is mountable on the swivel arm which is swivelable around a swiveling axis; means for calculating a diameter of the continuous-material reel on the roller; and means for determining a correction value for correcting a change in the angular speed, in response to a swivel motion of the swivel arm on which the roller is mounted;

setting a winding speed as a function of a web-conveyance speed, and calculating a diameter of the continuous-material reel in the reel-control system;

changing the winding speed when the swivel arm on which the roller is mounted is swiveled about its swiveling axis during a winding motion;

incorporating a correction value for correcting a change in the winding speed in the calculation of the diameter of the continuous-material reel; and determining the correction value within the reel-control system.

2. The method as defined in claim 1, further comprising using the correction value to precontrol the winding speed of the roller.

3. The method as defined in claim 1, further comprising determining a correction speed as the correction value, and calculating the diameter of the continuous-material reel based on the winding speed and the web-conveyance speed.

4. The method as defined in claim 1, further comprising determining a corrective angular position as the correction value, and calculating the diameter of the continuous-material reel based on an angular position of the roller and an angular position of a reference axle.

5. The method as defined in claim 1, further comprising determining the correction value as a function of a length and a swivel speed of the swivel arm.

6. The method as defined in claim 1, further comprising determining the correction value as a function of the length of the swivel arm and a current diameter.

7. The method as defined in claim 1, further comprising determining the correction value using a stored, geometry-dependent support-point characteristic curve.

8. The method as defined in claim 7, further comprising determining the stored support-point characteristic curve by an explicit measurement run based on measuring points.

9. The method as defined in claim 7, further comprising determining the stored support-point characteristic curve based on a knowledge of a geometrical configuration, with interpolation selected from the group consisting of interpolation being carried out between the support points, extrapolation being carried out beyond the support points, and both.

10. The method as defined in claim 1, further comprising determining the correction value as a function of a calculated, geometry-dependent factor.

11. The method as defined in claim 10, further comprising determining the calculated, geometry-dependent factor analytically.

12. A reel-control system, comprising:

means for controlling a winding motion of a roller with which it is rotatable at a changeable winding speed;

means for unwinding a continuous material from the roller and directing to a continuous-material machine or removing from a continuous-material machine and winding onto the roller;

means for controlling a swivel motion of a swivel arm with which the roller is mountable on the swivel arm which is swivelable around a swiveling axis;

means for calculating a diameter of the continuous-material reel on the roller; and means for determining a correction value for correcting a change in the angular speed, in response to a swivel motion of the swivel arm on which the roller is mounted.

13. A computer-readable medium containing a computer program, said computer program comprising:

program code means to carry out a method of calculating a diameter of a continuous-material reel on a roller mounted on a swivel arm pivotable about a swiveling axis and rotating at a changeable winding speed, with a continuous material unwound from the roller and directed to a continuous-material machine or removed from a continuous-material machine and wound onto the roller, the method comprising the steps of setting a winding speed as a function of a web-conveyance speed, and calculating a diameter of the continuous-material reel in a reel-control system, said reel-control system comprising means for controlling a winding motion of the roller with which it is rotatable at a changeable winding speed, means for unwinding the continuous material from the roller and directing to the continuous-material machine or removing from the continuous-material machine and winding onto the roller, means for controlling the swivel motion of the swivel arm with which the roller is mountable on the swivel arm which is swivelable around the swiveling axis, means for calculating a diameter of the continuous-material reel on the roller; and means for determining a correction value for correcting a change in the angular speed, in response to a swivel motion of the swivel arm on which the roller is mounted; changing the winding speed when the swivel arm on which the roller is mounted is swiveled about its swiveling axis during a winding motion; incorporating a correction value for correcting a change in the winding speed in the calculation of the diameter of the continuous-material reel; and determining the correction value within the reel-control system, wherein the computer program is run on a device selected from the group consisting of a computer and a related arithmetic unit.

14. A computer readable medium containing a computer program, said computer program comprising:

program code means to carry out a method of calculating a diameter of a continuous-material reel on a roller mounted on a swivel arm pivotable about a swiveling axis and rotating at a changeable winding speed, with a continuous material unwound from the roller and directed to a continuous-material machine or removed from a continuous-material machine and wound onto the roller, the method comprising the steps of setting a winding speed as a function of a web-conveyance speed, and calculating a diameter of the continuous-material reel in a reel-control system; changing the winding speed when the swivel arm on which the roller is mounted is swiveled about its swiveling axis during a winding motion; incorporating a correction value for correcting a change in the winding speed in the calculation of the diameter of the continuous-material reel; and determining the correction value within the reel-control system, wherein the computer program is run on a reel-control system, said reel-control system comprises means for controlling a winding motion of the roller with which it is rotatable at a changeable winding speed; means for unwinding the continuous material from the roller and directing to the continuous-material machine or removing from the continuous-material machine and winding onto the roller; means for controlling the swivel motion of the swivel arm with which the roller is mountable on the swivel arm which is swivelable around the swiveling axis; means for calculating the diameter of the continuous-material reel on the roller; and means for determining the correction value for correcting the change in the angular speed, in response to the swivel motion of the swivel arm on which the roller is mounted.

* * * * *